US006827602B2

(12) United States Patent
Greene et al.

(10) Patent No.: US 6,827,602 B2
(45) Date of Patent: Dec. 7, 2004

(54) HOSPITAL GRADE RECEPTACLE WITH POWER LIGHT INDICATOR

(75) Inventors: Jeff Greene, Sea Cliff, NY (US); John Eder, Floral Park, NY (US); Alfredo Arenas, Hauppauge, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/426,393

(22) Filed: Apr. 30, 2003

(65) Prior Publication Data

US 2004/0219823 A1 Nov. 4, 2004

(51) Int. Cl.[7] ..... H01R 3/00

(52) U.S. Cl. ..... 439/490; 439/488; 439/535; 439/538

(58) Field of Search ..... 439/488–490, 439/535, 538

(56) References Cited

U.S. PATENT DOCUMENTS

| | | | | | |
|---|---|---|---|---|---|
| 3,265,888 | A | * | 8/1966 | Adolphson, Jr. | 362/95 |
| 3,588,489 | A | * | 6/1971 | Galaes | 362/95 |
| 4,855,719 | A | * | 8/1989 | Posey | 340/568.3 |
| 5,146,385 | A | * | 9/1992 | Misencik | 361/56 |
| 5,277,620 | A | * | 1/1994 | Taylor | 439/490 |
| 5,413,501 | A | * | 5/1995 | Munn | 439/535 |
| 6,078,113 | A | * | 6/2000 | True et al. | 307/147 |
| 6,290,533 | B1 | * | 9/2001 | Major | 439/490 |
| 6,334,787 | B1 | * | 1/2002 | Chang | 439/490 |
| 6,488,529 | B1 | * | 12/2002 | Chen | 439/490 |

* cited by examiner

*Primary Examiner*—Truc T. T. Nguyen
(74) *Attorney, Agent, or Firm*—Paul J. Sutton

(57) ABSTRACT

This invention is directed to a receptacle having an indictor which identifies the receptacle as being a hospital grade receptacle. The indicator can be a green colored window in the face of the receptacle that is always visible. A light emitting means such as a light emitting diode located behind the window and coupled across the phase and neutral contacts of the receptacle provides a positive indication that the receptacle is connected to a live circuit.

16 Claims, 11 Drawing Sheets

HOSPITAL GRADE RECEPTACLE WITH POWER LIGHT INDICATOR

BACKGROUND OF THE INVENTION

1. Field of the Invention

This invention relates generally to hospital grade receptacles and, more specifically to a hospital grade receptacle having a new improved identifier.

2. Background of the Invention

The National Electric Code published by the National Fire Protection Association, and as revised from time to time specifies that receptacles that are used in hospitals and may be wired to an emergency power supply branch circuit be designated with a distinguishing feature. This requirement is commonly met by marking hospital grade receptacles with a distinctive color such as, for example, a green dot. In contrast, general purpose receptacles located within a hospital are normally of a non-conspicuous color such as ivory or white without a distinguishing mark. It is to be noted that electrical receptacle manufactures may manufacture as many as four different grades of receptacles which are classified as residential grade receptacles, commercial grade receptacles, industrial grade receptacles and hospital grade receptacles. Of the four grades, the hospital grade receptacle is made to the highest and most rigid mechanical and electrical standards. The distinctive color, such as the green dot permits health care personnel to immediately identify the receptacle as being both a hospital grade receptacle and that it may be connected to an emergency power supply branch circuit of the hospital. Unfortunately, the green dot can not indicate to a health care person that the hospital grade receptacle is connected to a "live" emergency power supply branch circuit and is ready to power equipment connected to it. Thus, in those instances where there is an immediate need to connect a medical device to a source of power, the health care person may unknowingly plug the needed device into a hospital grade receptacle that is not connected to a "live" circuit. As the device that is plugged in will not operate because the receptacle in not currently energized, the health care person may reasonably assume that the non-operating device is defective, not that the device is connected to a receptacle with no power, and will lose valuable time searching for another device to use. Clearly, what is needed is a receptacle that can be easily and readily identified by a health care person that the receptacle is not only a hospital grade receptacle but, in addition, that the receptacle is connected to a live electrical circuit.

SUMMARY OF THE INVENTION

This invention is directed to a receptacle having an indicator which identifies the receptacle as being a hospital grade receptacle. The indicator can be a green colored window in the receptacle face that is always visible. A light emitting means such as a light emitting diode located behind the window and coupled across the phase and neutral contacts of the receptacle provides a positive indication that the receptacle is connected to a live circuit.

The above and other aspects, features and advantages of the invention will be more readily apparent from the description of the preferred embodiments taken in conjunction with the accompanying drawings and appended claims.

BRIEF DESCRIPTION OF THE DRAWINGS

The invention is illustrated by way of example, and not limitation, in the figures of the accompanying drawings in which like reference characters denote like and corresponding parts and in which.

DESCRIPTION OF THE PREFERRED EMBODIMENT

Figure 1:
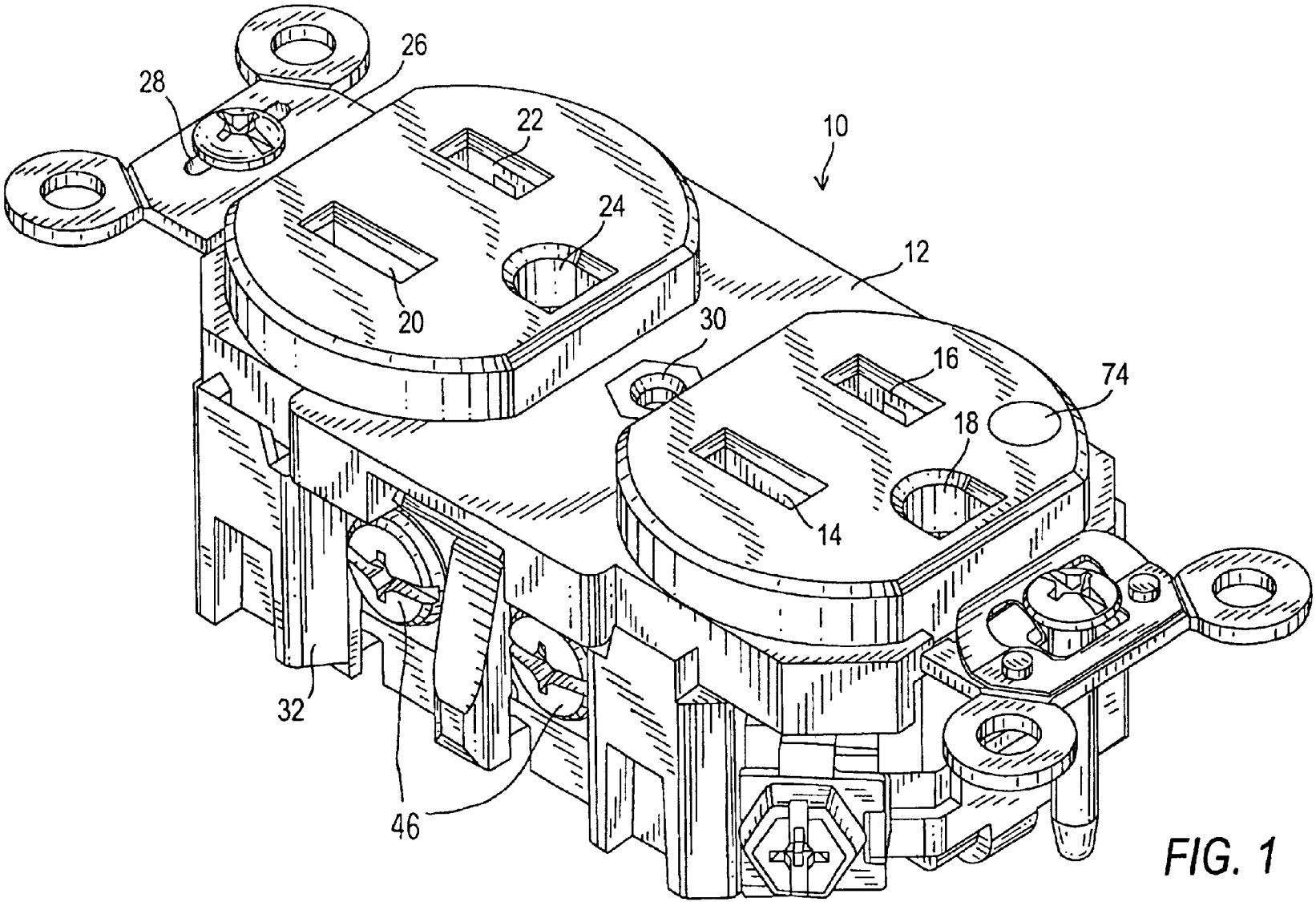
FIG. 1 is a side perspective view of a 15 amp. or 20 amp. 125 volt duplex electrical receptacle having an indicator in accordance with the principles of the invention.

Referring to FIG. 1, there is shown a side perspective of a duplex 15 amp. 125 volt electrical receptacle 10 having a face 12 in accordance with the principles of the invention. Apertures 14,16 and 18 in the face plate are arranged to receive the neutral, phase and ground blades of a first electrical plug, and apertures 20, 22 and 24 are arranged to receive the neutral, phase and ground blades of a second electrical plug. A mounting strap 26 having slots 28 permits the receptacle 10 to be mounted to threaded mounting holes of a standard outlet box (not shown). A threaded aperture 30 permits a wall plate (not shown) to be installed over the receptacle 10.

Figure 2:
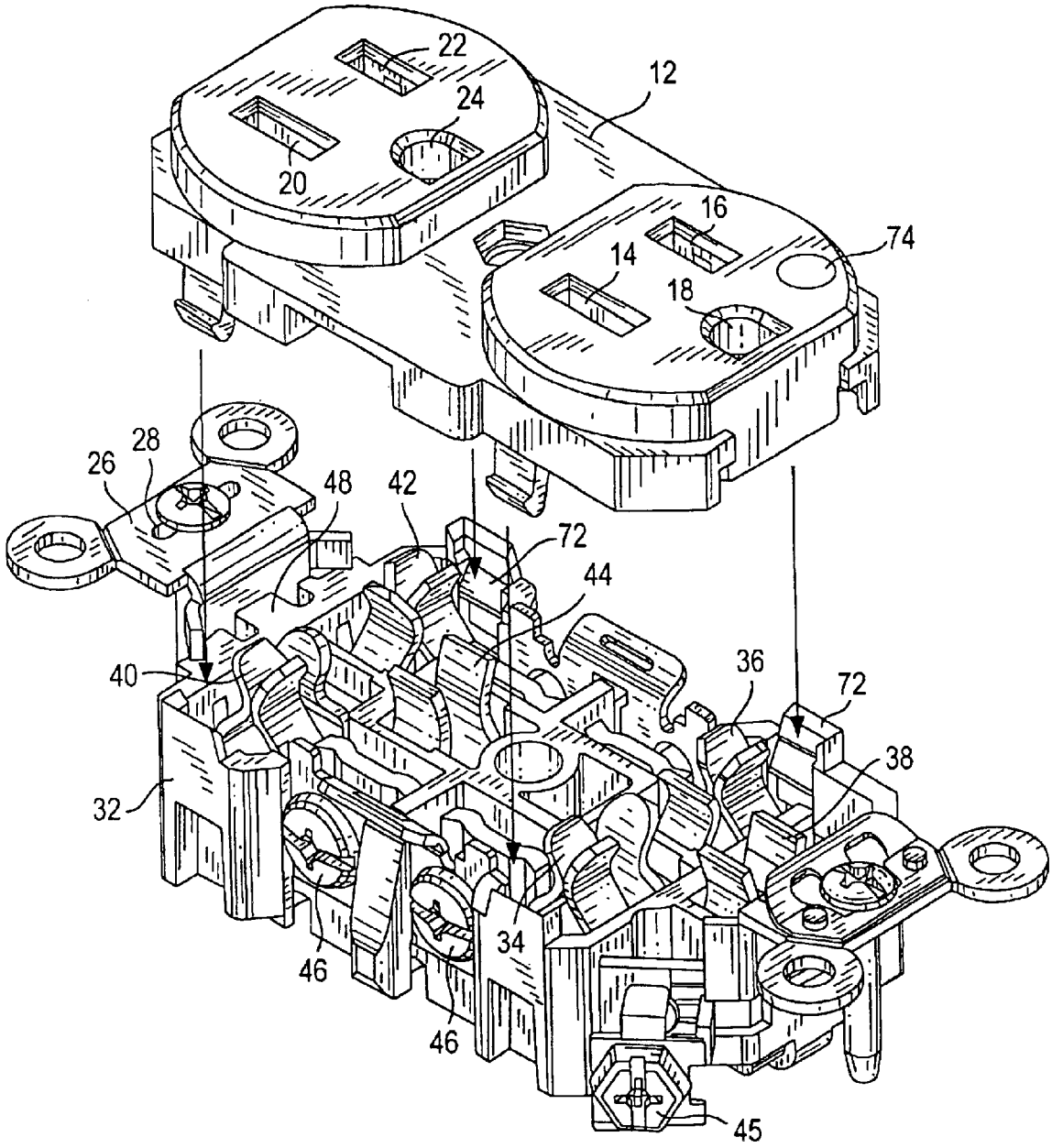
FIG. 2 is a partial exploded, side perspective view of the duplex electrical receptacle of FIG. 1.
Figure 3:
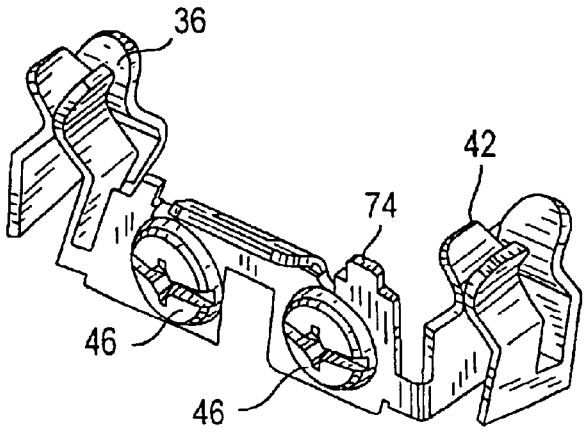
FIG. 3 is a perspective view of the phase contacts prior to being placed within the base member of the duplex receptacle.
Figure 4:
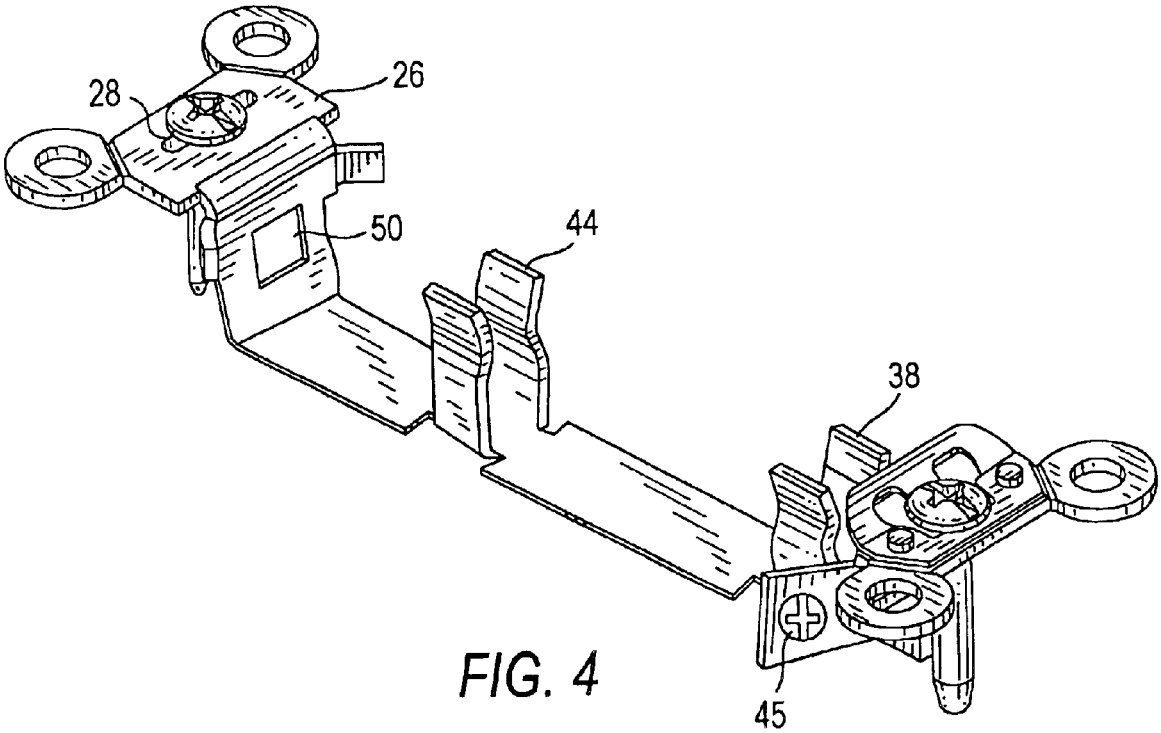
FIG. 4 is a perspective view of mounting strap and ground contacts prior to being assembled to the base member of the duplex receptacle.

Referring to FIG. 2, there is illustrated a partial exploded side perspective view of the duplex receptacle of FIG. 1 wherein base member 32 has a top contact section 33 which contains a number of chambers defined by insulation barriers within which are placed electrical contacts for receiving the prongs of a plug and adapted, by means of screw terminals 46, to be connected to conductors of an AC power source. As best seen in FIG. 2, insulation barriers are provide to form chambers to house the neutral and phase electrical contact 34, 36 and ground contact 38 for one plug. In a similar manner, insulation barriers are provided to form chambers to house neutral and phase electrical contacts 40, 42 and ground contact 44 for a second plug. FIG. 3 is an isometric view of one set of contacts such as phase contacts 36, 42 adapted to be connected to the phase blade of a plug and the phase conductor of a source of electricity. A similar set of contacts such as neutral contacts 34, 40 (see FIG. 2) are adapted to be connected to the phase blades of two plugs and the phase conductor of the source of electricity. Terminal screws 46 located on the side surface of the base member are provided for connecting contacts 36, 42 to the phase conductor of a source of power. In a similar manner, two terminal screws located on the other side surface of the base member are provided to couple the other set of contacts 34, 40 to the neutral conductor of a source of power. Referring to FIG. 4, mounting strap 26 supports ground contacts 38, 44 which, in the assembled receptacle, are located in separate chambers of the base member formed by insulating barriers. Mounting strap 26 is coupled to base member 32 by means of two projections 48 (see FIG. 2) located on the base member which engage openings 50 (see FIG. 4) in each side leg of the mounting strap. In one embodiment the chambers for housing the ground contacts have open bottoms to allow the ground contacts to enter their respective chamber from the bottom. A terminal screw 45 connected to the mounting strap is provided for connecting a ground conductor to the mounting strap to provide a ground connection for the ground contacts 38, 44.

Figure 5:
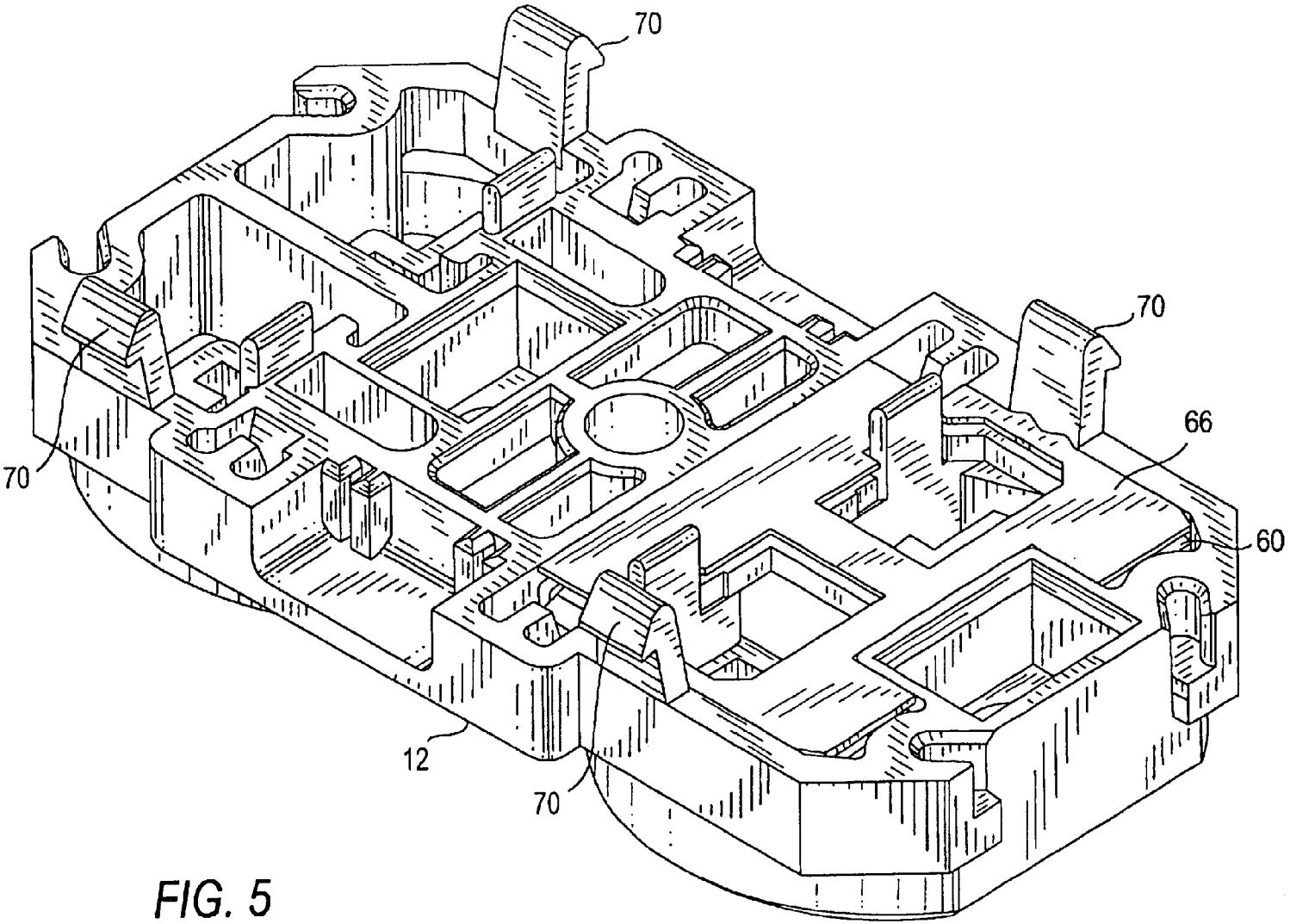
FIG. 5 is a perspective view of the underside of the face of a 15 amp. 125 volt and 20 amp. 125 Volt duplex electrical receptacle showing an insulating member covering the bottom of a printed circuit board located in the receptacle face.

Referring to FIG. 5, there shown a perspective view of the underside of the face 12 of the duplex electrical receptacle supporting a printed circuit board covered by an insulating member 66. As shown in FIG. 5, the printed circuit board is located within the underside of the receptacle face and is supported by the edges of some of the insulating barriers. The printed circuit board assembly comprises a series circuit of a resistor 54, a diode 56 and a light emitting diode 58 (LED). See FIG. 6.

Figure 6:
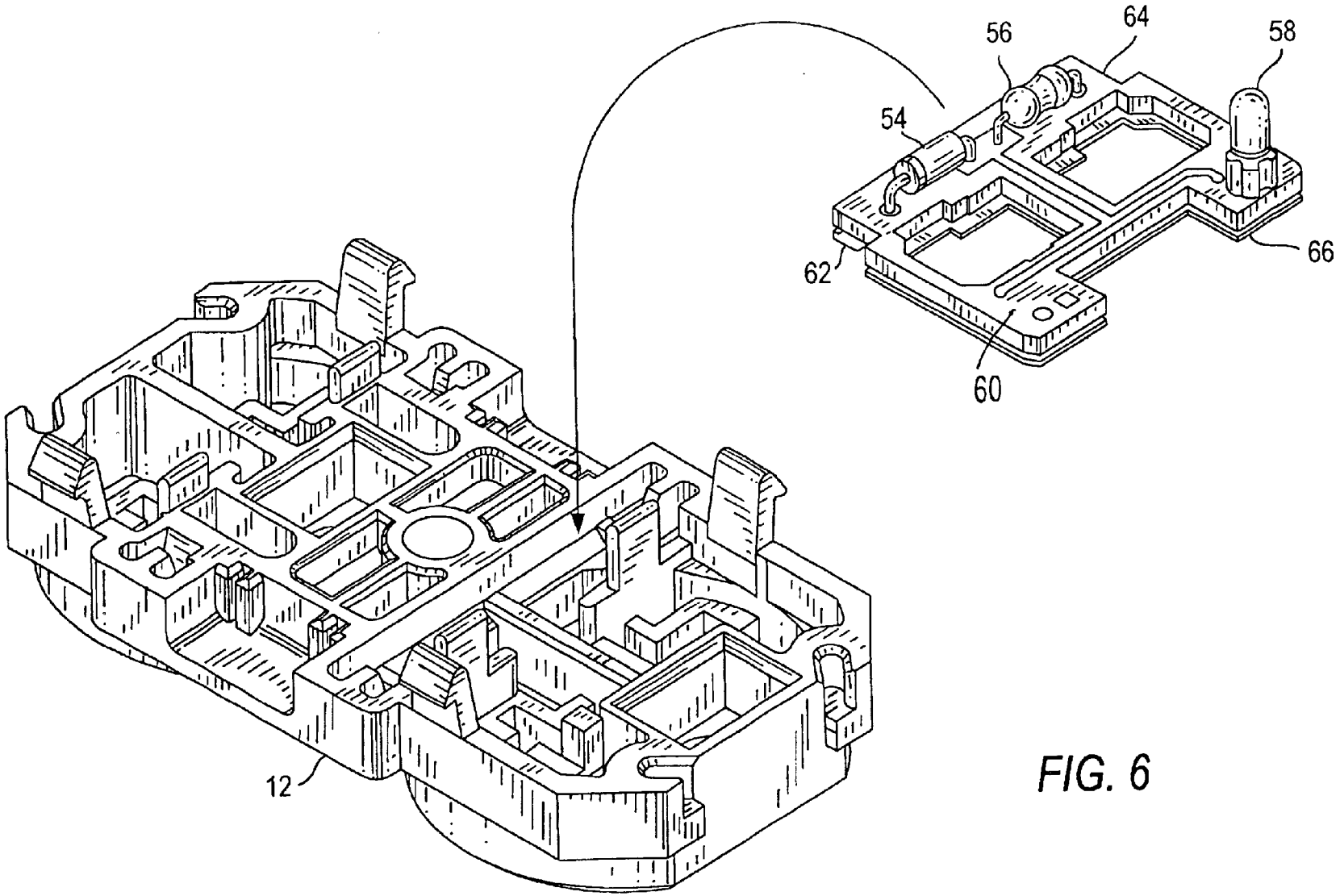
FIG. 6 is an exploded side perspective partial assembly of the underside of the face of a 15 amp. 125 volt and 20 amp. 125 volt duplex electrical receptacle and the printed circuit board assembly.

Referring to FIG. 6, there is shown the printed circuit board 60 about to be positioned into the underside of face 12. The top surface of the printed circuit board 60 supports the resistor 54, diode 56 and LED 58 which are electrically coupled via conductive traces to a first contact pad 62 and a second contact pad 64. Contact pad 62 is located at one end of the series circuit of the resistor, diode and LED; and the second contact pad 64 is located at the other end of the series circuit.

Figure 7:
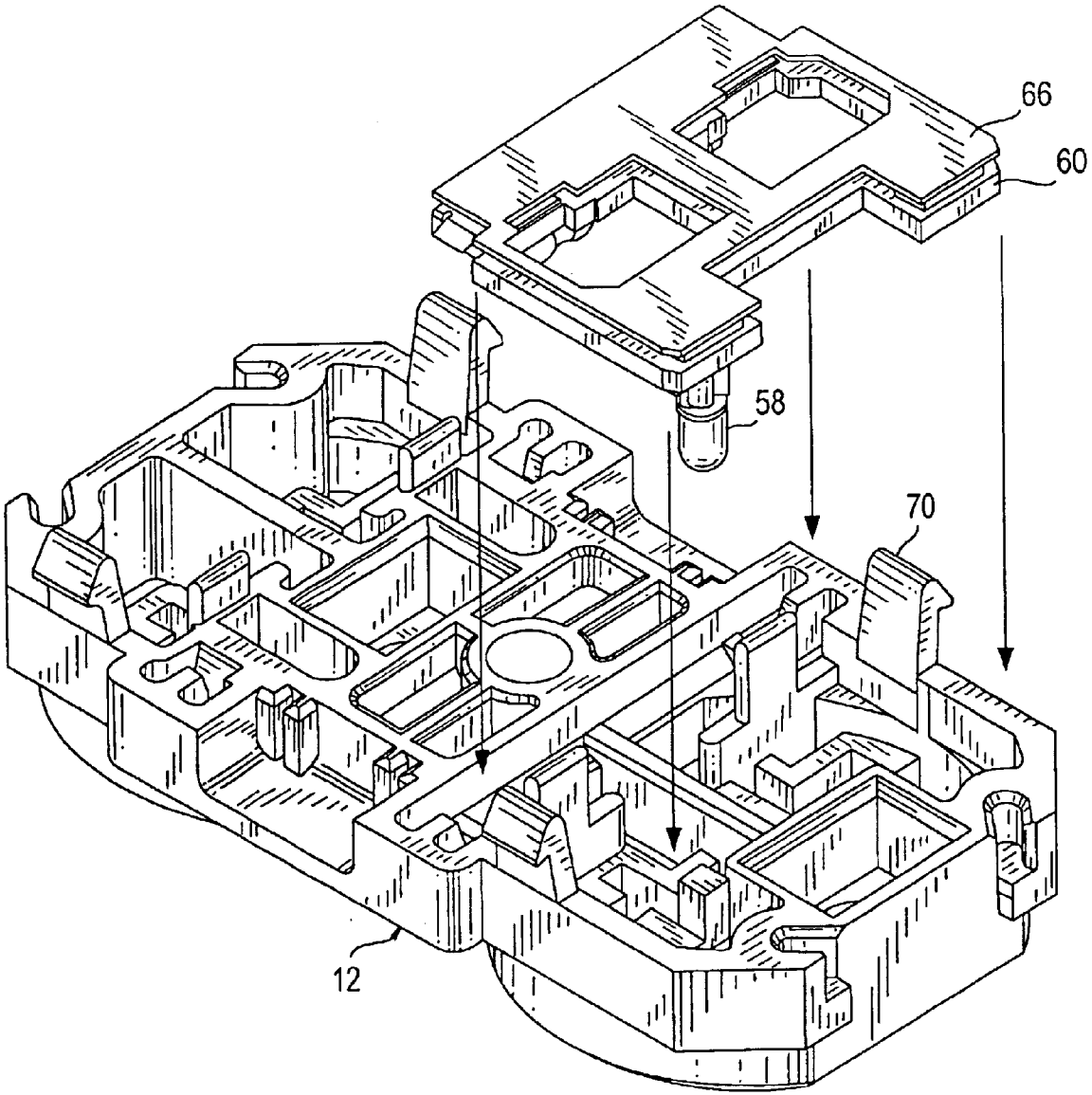
FIG. 7 is another exploded side perspective partial assembly of the underside of the face of a 15 amp. 125 volt and 20 amp. 125 volt duplex electrical receptacle and printed circuit board assembly.

FIG. 7 is another exploded side perspective partial assembly view of the underside of the face of the duplex electrical receptacle just prior to receiving the assembled printed circuit board. The printed circuit board, when positioned within the face of the receptacle, is supported by ends of the insulating barriers, and the light emitting diode 58 is positioned directly behind the window 74 (see FIG. 2) in the receptacle face.

Figure 9:
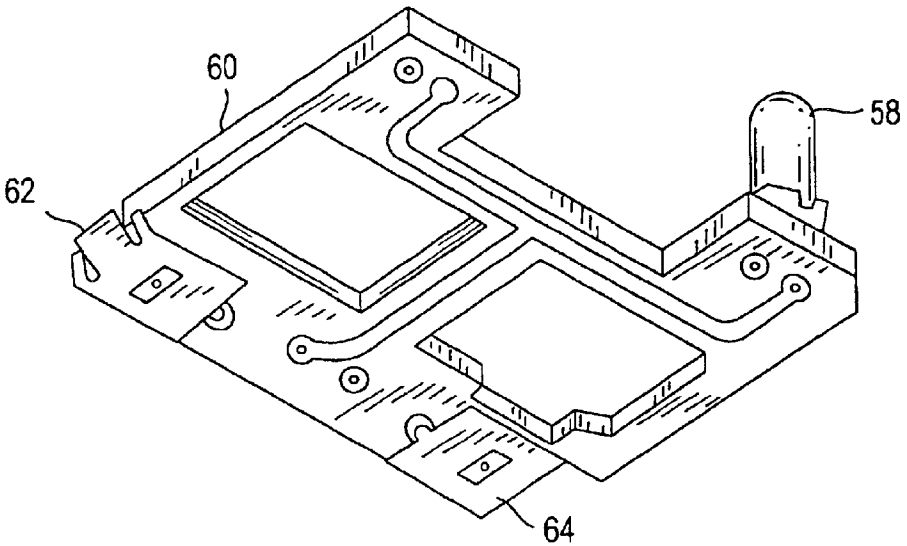
FIG. 9 is a bottom perspective view of the printed circuit board assembly.
Figure 8:
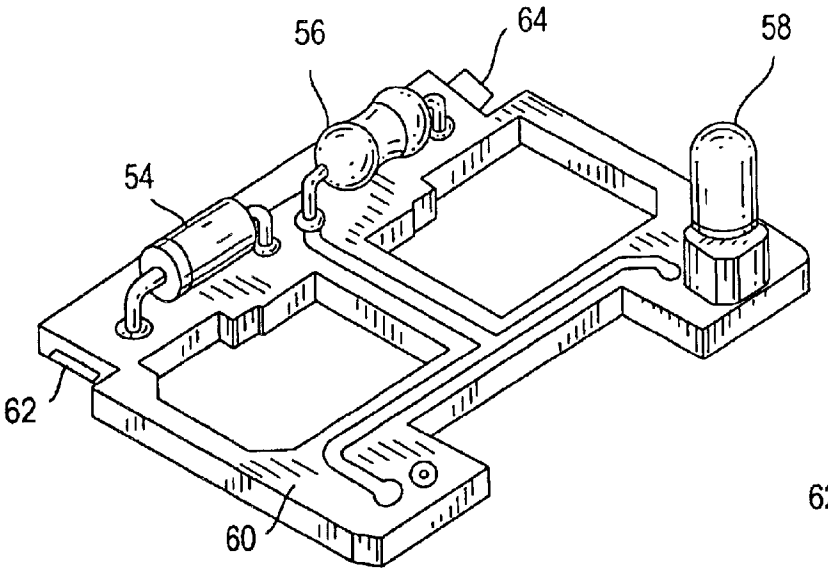
FIG. 8 is a top perspective view of the printed circuit board assembly.

Referring to FIGS. 8 and 9, the series resistor 54, diode 56, light emitting diode 58 circuit on the printed circuit board 60 is connected as follows: Initially, it is to be noted that each of the three components, the resistor 54, the diode 56 and the LED 58 are located on the top side of the printed circuit board. Contact pad 62 is connected via a conductive trace on the underside of the board 60 to a first lead of the resistor 54. The second lead of the resistor 54 is connected via a conductive trace on the underside of the board to a first lead of the LED 58. The second lead of the LED 58 is connected to a first lead of the diode 56 via a conductive trace on the top side of the printed circuit board, and the second lead of the diode 56 is connected to the contact pad 64 via a conductive trace on the underside of the printed circuit board.

As noted above, this invention is directed to providing an identifier for a receptacle to identify the receptacle as being a hospital grade receptacle and, in addition, to indicate if the circuit that is connected to the receptacle is a live circuit. This invention is not limited to any one specific type of hospital grade receptacle, but can be use in combination with any hospital grade receptacle. The receptacle itself, not including the identifier, shown in the Figs. is representative of any hospital grade receptacle.

Figure 10:
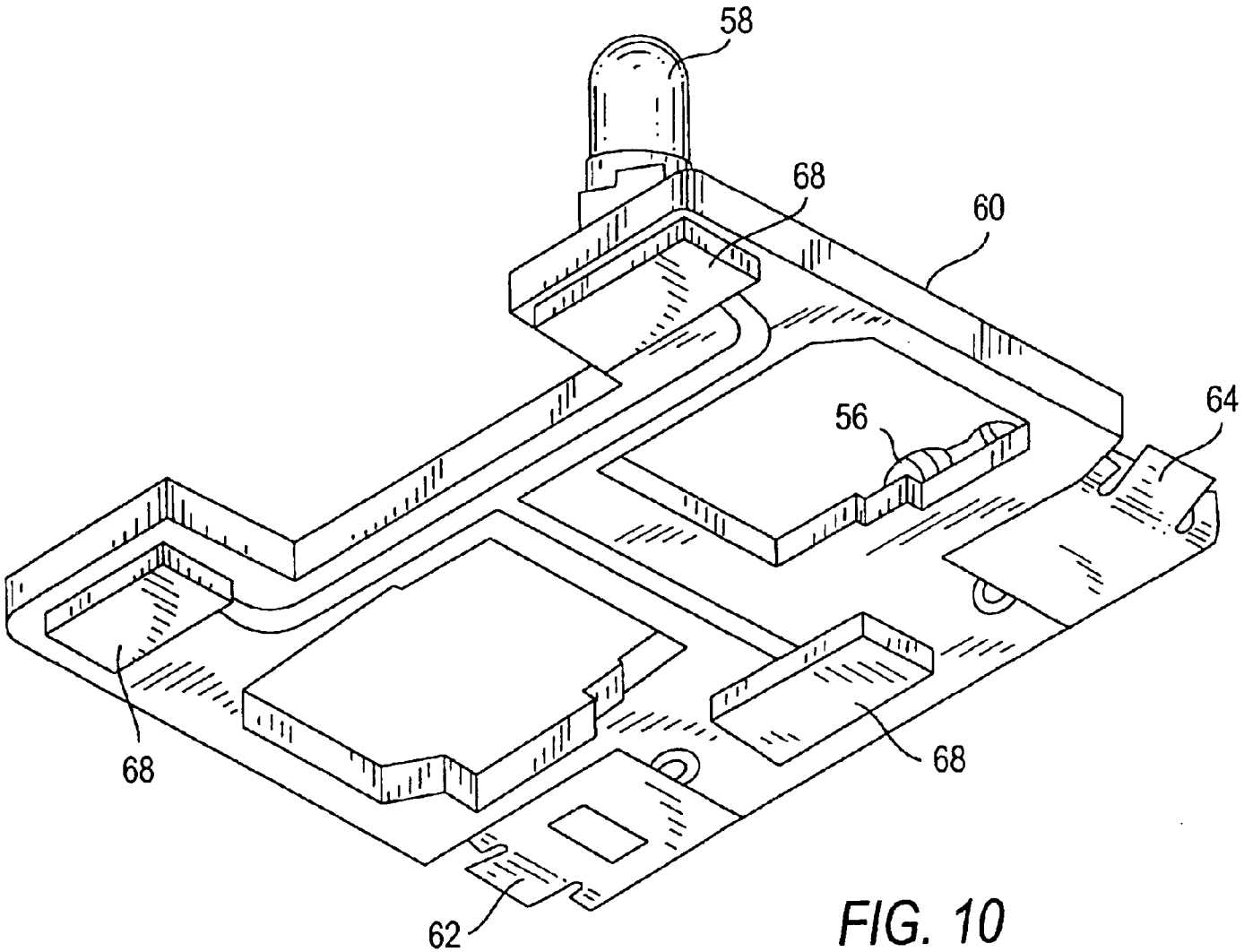
FIG. 10 is a bottom perspective view of the printed circuit board assembly showing the location of room temperature vulcanizing silicon dabs for holding an insulating member.
Figure 11:
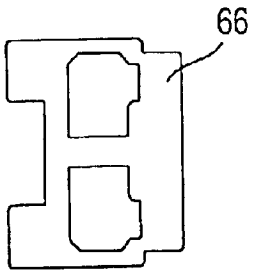
FIG. 11 is a view of the insulating member.
Figure 12:
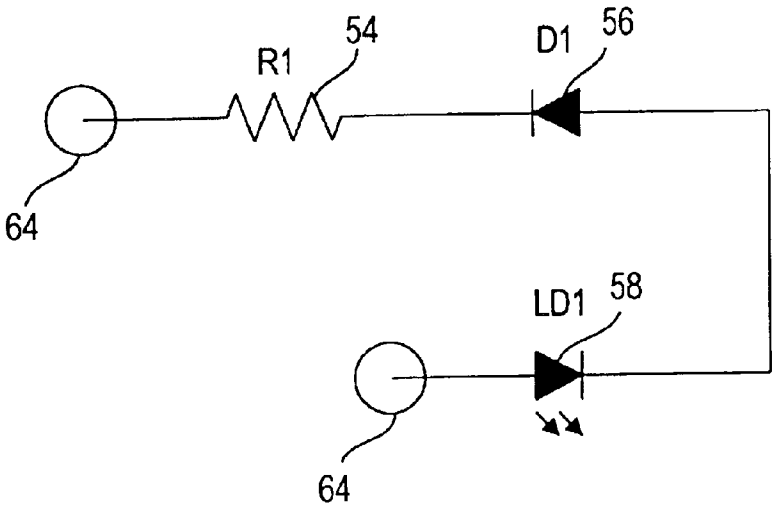
FIG. 12 is a schematic diagram of the circuit on the printed circuit board.

Referring to FIGS. 5, 6 and 7, to assemble the printed circuit board into the face of the receptacle, the face may be positioned underside up to receive the printed circuit board. The printed circuit board, shown in FIG. 6 as being right side up, is turned over, see FIG. 7, and placed on top of the insulation barriers on the inside of the face 12. The face 12 has a window opening 74 which extends through the top surface of the face and the LED 58 on the printed circuit board is aligned with the window to allow light from the LED to pass through the window to be visible from the outside of the receptacle. The window 74 in the face can have a round green lens which will not only help identify the receptacle as being a hospital grade receptacle, and, at the same time, help keep dirt from entering the receptacle. A sheet of fiber insulating material 66, see FIG. 11 is attached to the bottom of the printed circuit board. The sheet of insulating material is held to the bottom of the printed circuit board with room temperature vulcanizing (RTV) silicon. FIG. 10 shows the location of three small dabs 68 of RTV on the bottom surface of the printed circuit board for holding the fiber insulating material to the printed circuit board. The fiber insulating material covers the bottom surface of the printed circuit board.

After the printed circuit board and attached fiber insulating material is positioned within the face as shown in FIG. 5, the base member is assembled to the face 12 and held in place by means of locking tabs 70 (see FIG. 5) located on the face which engage holding members 72 (see FIG. 2) on the base member. As the base member is moved toward the face, the ends of the contact pads 62, 64 on the printed circuit board engage and make electrical contact with the neutral and phase contacts in the base member. More specifically, the end of conductive pad 64 makes electrical contact with the small vertical projection 74 (see FIG. 3) on the neutral contact and the end of conductive pad 62 makes electrical contact with a similar small vertical projection of the phase contact.

Figure 13:
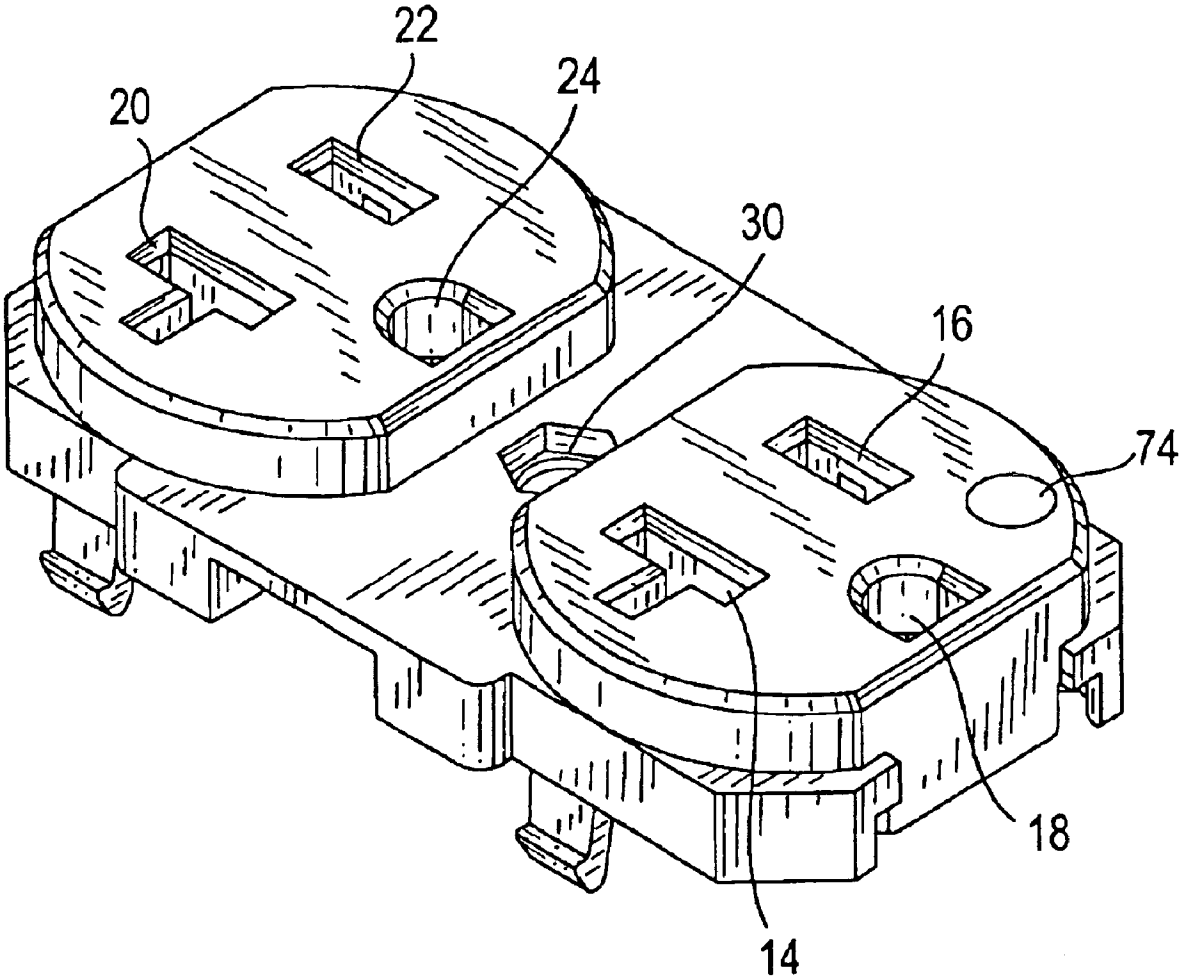
FIG. 13 is a perspective view of the top of the face of a 20 amp. 125 volt receptacle in accordance with the principles of the invention.

Referring to FIG. 13, there is illustrated the face of a 20 amp. 125 volt receptacle with indicator in accordance with the principles of the invention.

Figure 14:
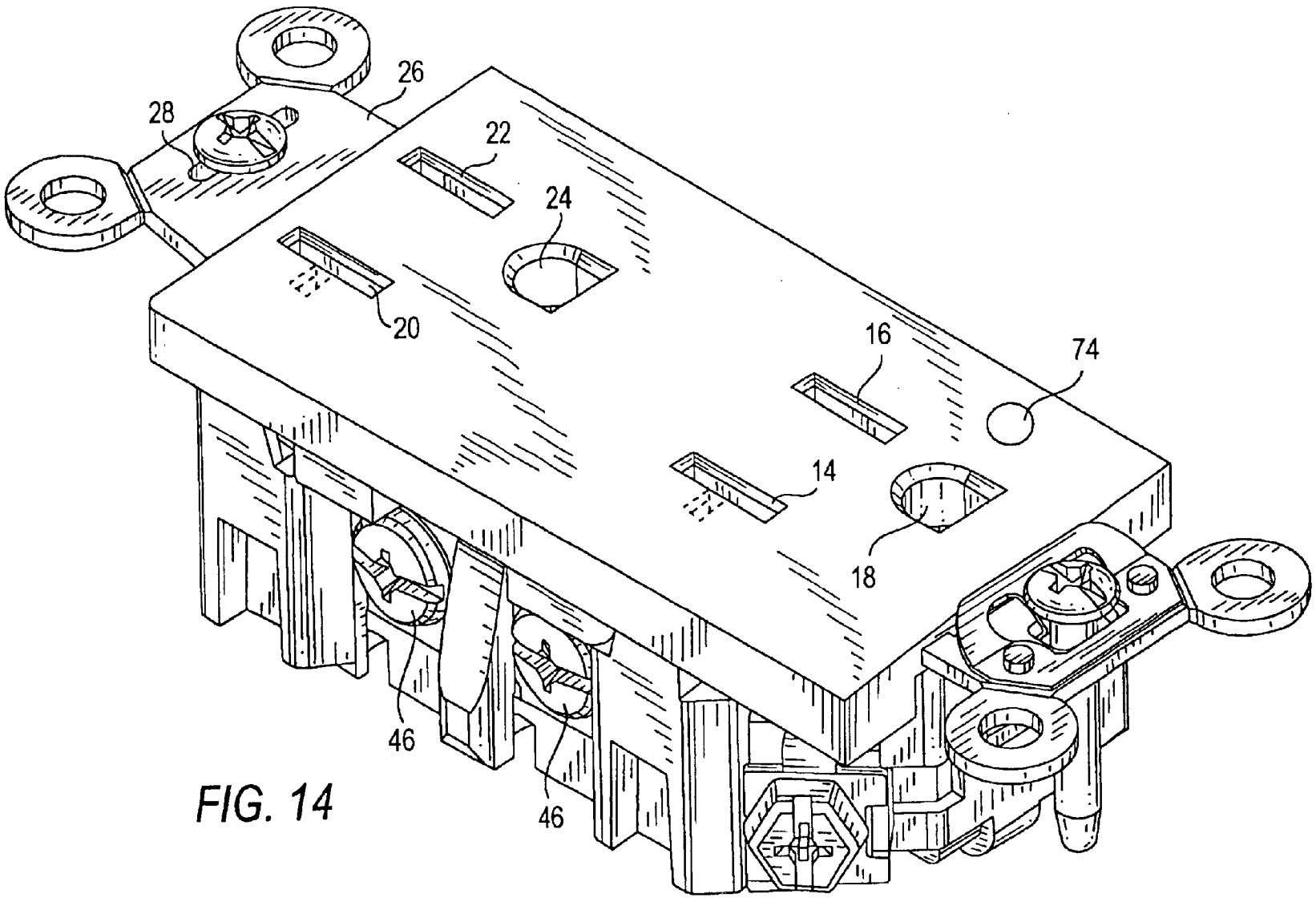
FIG. 14 is a perspective view of a 15 amp. 125 volt, and in phantom, a 20 amp. 125 volt duplex electrical receptacle having a flat face and an indicator in accordance with the principles of the invention.

FIG. 14 shows a flat face of a 15 amp. 125 volt receptacle and, in phantom, a 20 amp. 125 volt receptacle in accordance with the principles of the invention.

While there have been shown and described and pointed out the fundamental novel features of the invention as applied to the preferred embodiment, as is presently contemplated for carrying them out, it will be understood that various omissions and substitutions and changes of the form and details of the device illustrated and in its operation may be made by those skilled in the art, without departing from the spirit of the invention.

What is claimed is:

1. A hospital grade receptacle having a face with at least two openings for receiving the prongs of a plug, a phase terminal located behind one of the openings and a neutral terminal located behind the other opening comprising;

a lens of color located in a window located in the face which is always visible and which identifies the receptacle as a receptacle which, when in use, is connected to a "live" emergency power supply branch circuit; and a light emitting diode located behind said lens of color to indicate that the receptacle, when in use, is actually connected to a live circuit by emitting light through the lens of color wherein the light emitting diode is coupled across the phase and neutral terminals of the receptacle.

2. The receptacle of claim 1 wherein the light emitting diode is in series with a resistor.

3. The receptacle of claim 1 wherein the light emitting diode is in series with a resistor and a diode.

4. The receptacle of claim 1 wherein the window is round.

5. The receptacle of claim 1 wherein the window is flush with the surface of the face plate.

6. The receptacle of claim 1 wherein the color of the window is green.

7. The receptacle of claim 3 wherein the series circuit of the light emitting diode, the resistor and the diode are coupled to a printed circuit board having a first contact pad that contacts the phase terminal and a second contact pad that contacts the neutral terminal.

8. The receptacle of claim 7 wherein the receptacle is a duplex receptacle.

9. The receptacle of claim 8 wherein the receptacle is a 15 amp. 125 volt receptacle.

10. The receptacle of claim 8 wherein the receptacle is a 20 amp. 125 volt receptacle.

11. The receptacle of claim 7 wherein the face around the openings for receiving the prongs of a plug is raised.

12. The receptacle of claim 7 wherein the face is flat.

13. The receptacle of claim 7 wherein the light emitting diode, the resistor and the diode are on a first side of the printed circuit board, and the first contact pad is connected via a conductive trace on the second side of the board to a first lead of the resistor, a second lead of the resistor is connected via a conductive trace on the second side of the board to a first lead of the light emitting diode, a second lead of the light emitting diode is connected to a first lead of the diode via a conductive trace on the first side of the board, and the second lead of the diode is connected to the second contact pad via a conductive trace on the second side of the board.

14. The receptacle of claim 13 comprising insulating material coupled to the second side of the board.

15. The receptacle of claim 14 comprising silicon adhesive to couple the insulating material to the second side of the board.

16. The receptacle of claim 13 wherein the first and second contact pads are located on the second side of the board.

* * * * *